US005876292A

United States Patent [19]

Hamilton

[11] Patent Number: 5,876,292

[45] Date of Patent: Mar. 2, 1999

[54] AUDIBLE WRIST ANGLE INDICATOR FOR GOLFERS

[76] Inventor: David Paul Hamilton, 113 Cowden St., Shannon, Mich. 38868

[21] Appl. No.: 71,102

[22] Filed: May 1, 1998

[51] Int. Cl.[6] ..... A63B 69/36

[52] U.S. Cl. ..... 473/213; 273/DIG. 30; 473/458

[58] Field of Search ..... 473/213, 214, 473/205, 276, 458; 273/DIG. 30

[56] References Cited

U.S. PATENT DOCUMENTS

| | | | |
|---|---|---|---|
| 2,064,603 | 12/1936 | Harrison | 35/29 |
| 2,468,580 | 4/1949 | Weis et al. | 473/214 |
| 2,831,196 | 4/1958 | Scheiber | 2/161 |
| 3,235,258 | 2/1966 | Stroberg | 273/54 |
| 3,350,100 | 10/1967 | Carmines | 273/183 |
| 3,436,075 | 4/1969 | Robinson | 273/26 |
| 3,606,343 | 9/1971 | Lemon | 273/189 R |
| 3,700,245 | 10/1972 | Nannini | 273/189 A |
| 3,861,688 | 1/1975 | Butler | 273/183 B |
| 4,088,318 | 5/1978 | Massman | 473/213 |
| 4,222,569 | 9/1980 | DeMascolo | 273/183 B |
| 4,257,607 | 3/1981 | Nedwick | 273/183 B |
| 5,149,085 | 9/1992 | Sanchez | 273/1.5 A |
| 5,207,430 | 5/1993 | Goins | 273/189 R |
| 5,324,038 | 6/1994 | Sasser | 273/183.1 |
| 5,492,331 | 2/1996 | Kawakami | 273/189 A |
| 5,509,809 | 4/1996 | Clay | 473/202 |
| 5,511,788 | 4/1996 | Manley et al. | 473/213 |

OTHER PUBLICATIONS

1997, TACTIC (photo –copy of product) Novato, CA. 94945.

*Primary Examiner*—George J. Marlo
*Attorney, Agent, or Firm*—John V. Stewart

[57] ABSTRACT

An elongated clicker (1) attached to a base (2). The base is rigid enough to distribute the pressure of the clicker on the wrist via padding (11). It is made of a lightweight material such as molded plastic, and is attached to the wrist by an adjustable strap (6). The clicker has a slidable adjustment block (12) which distributes and positions the pressure of the clicker on the back of the hand for optimum comfort and selectable clicker timing.

6 Claims, 4 Drawing Sheets

AUDIBLE WRIST ANGLE INDICATOR FOR GOLFERS

BACKGROUND

1. Field

Figure 1:
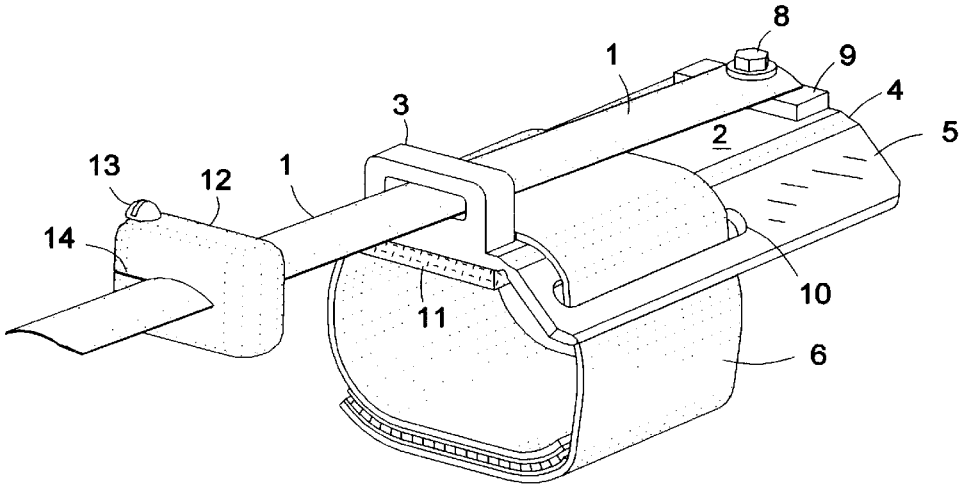

This invention relates to golf swing practice aids, especially to devices producing audible feedback of wrist angle during a golf swing.

2. Prior Art

Various means for sensing and indicating the wrist angle, or constraining the wrist to a particular angle, for training in sports such as golf and bowling, have been used in the past. However, an ideal combination of practicality, sensitivity, comfort, adjustability, and economy have not been achieved.

U.S. Pat. No. 2,831,196 (Scheiber) shows a golf glove with splints (14 and 15) in pockets oriented longitudinally across the back of the wrist. The splints are tightened against the wrist so that cocking the wrist causes a discomfort that reminds the golfer not to cock the wrist too soon in the back-swing.

U.S. Pat. No. 2,064,603 (Harrison) shows an Audible Signal Device for use in golf and other sports. It has a case the shape and size of a wrist watch, with a wrist band attached. The case is strapped to any side of the wrist, and has a forward extending lever which contacts the hand adjacent the wrist for indicating bending of the wrist toward the case. The lever depresses a spring steel clicker in the case to alert the user. The timing is adjusted by replacing the lever with one of a different size, or by bending the lever.

A device on the market as of this writing has an elongated spring steel clicker in a flexible envelope attached longitudinally across the back of the wrist by a strap around the wrist. A retainer loop on the front end of the clicker can be placed around a finger of the hand. In operation, the clicker presses against a location on the back of the hand and against a second location on the wrist. These pressure points are not adjustable as to position. Clicker timing is adjusted via the tension of the wrist strap.

OBJECTS AND SUMMARY

The objective of the present invention is provision of an audible wrist angle indicator for golfers that is comfortable, economical, and adjustable. Another object is to provide a clicker with a timing adjustment that is independent of the wrist strap tension, to allow setting the wrist strap tension for optimum comfort. Another object is to allow the user to select a comfortable location of the pressure point for the is clicker on the back of the hand. Another object is to disperse and cushion the pressure of the back end of the clicker against the wrist.

These objectives are achieved by an elongated clicker (1) attached to a base (2). The base is rigid enough to distribute the pressure of the clicker on the wrist via padding (11), is economically made of a lightweight material such as molded plastic, and is attached to the wrist by a wide, adjustable strap (6). The clicker has a slidable adjustment block (12) which distributes and positions the pressure of the clicker on the back of the hand for optimum comfort and selectable clicker timing.

DRAWINGS

FIG. 1 Perspective view of invention

Figure 2:
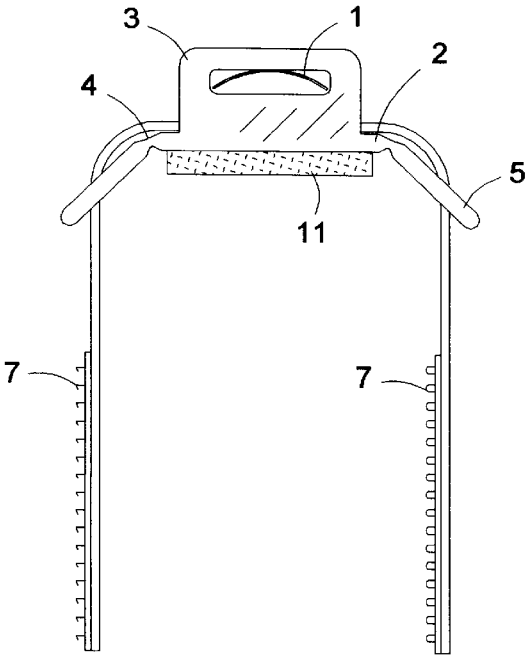
Figure 4:
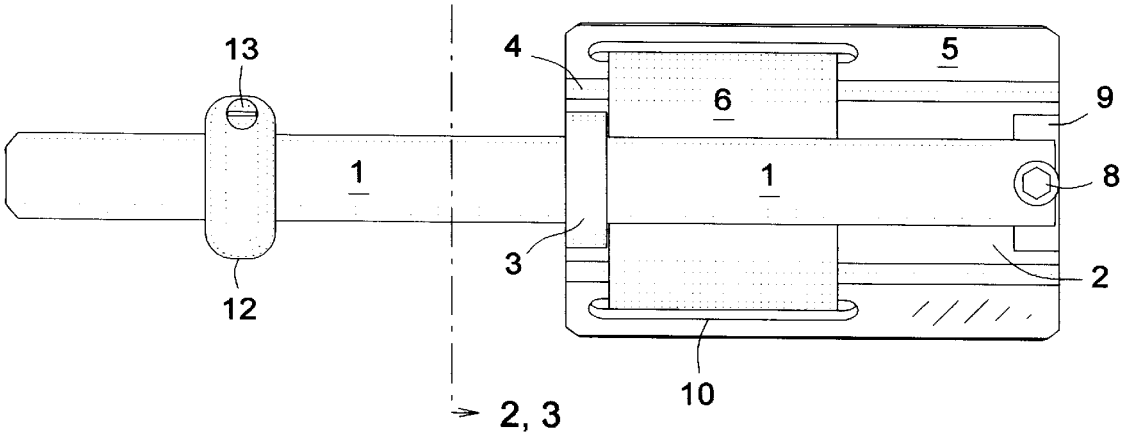
Figure 5:
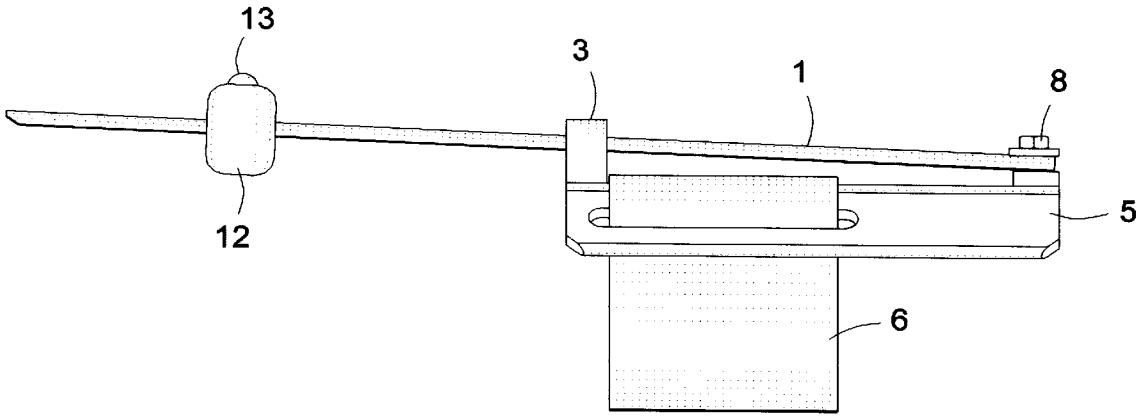

FIG. 2 Front view taken along line 2,3 of FIG. 4.

Figure 3:
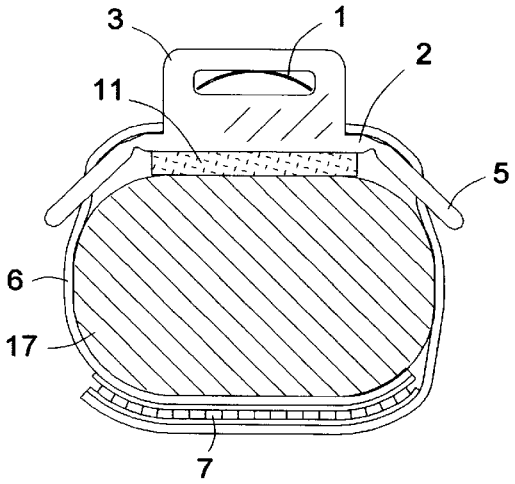

FIG. 3 Front view as in FIG. 2, with strap (6) attached to wrist (17)

FIG. 4 Top view

FIG. 5 Side view

Figure 6:
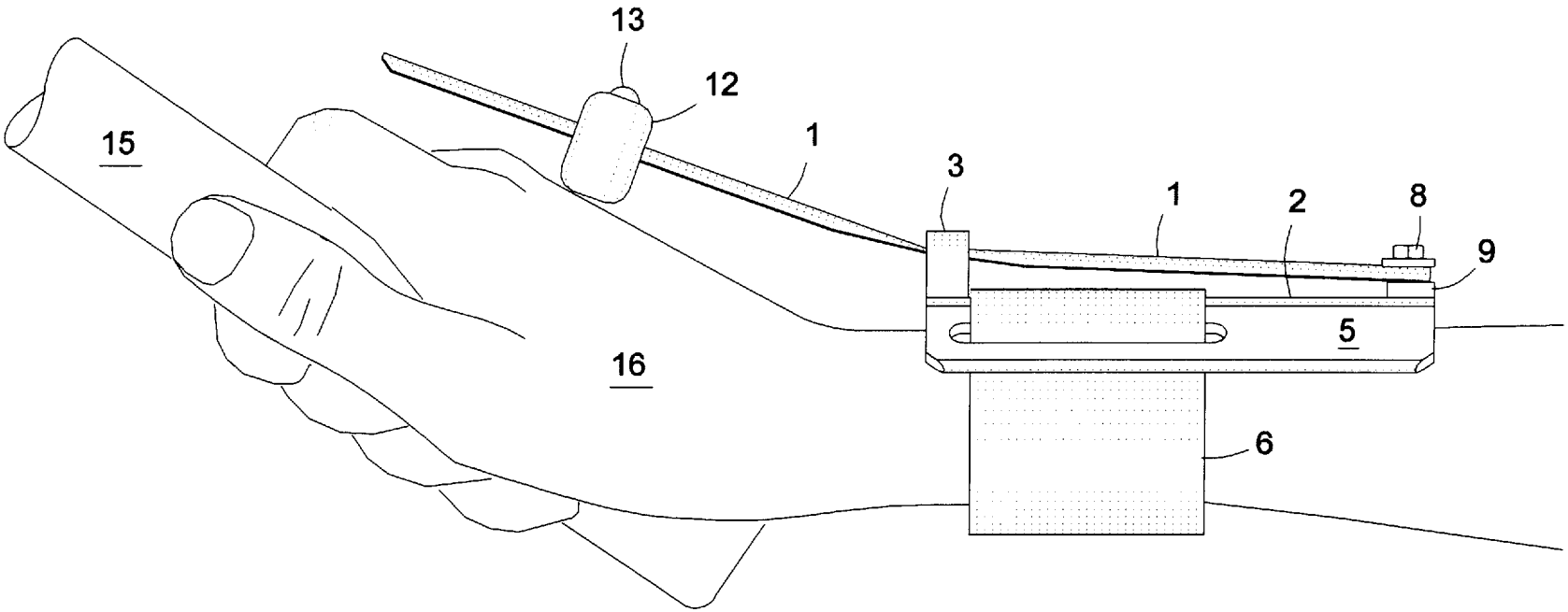

FIG. 6 Side view of invention on cocked wrist of a user

Figure 7:
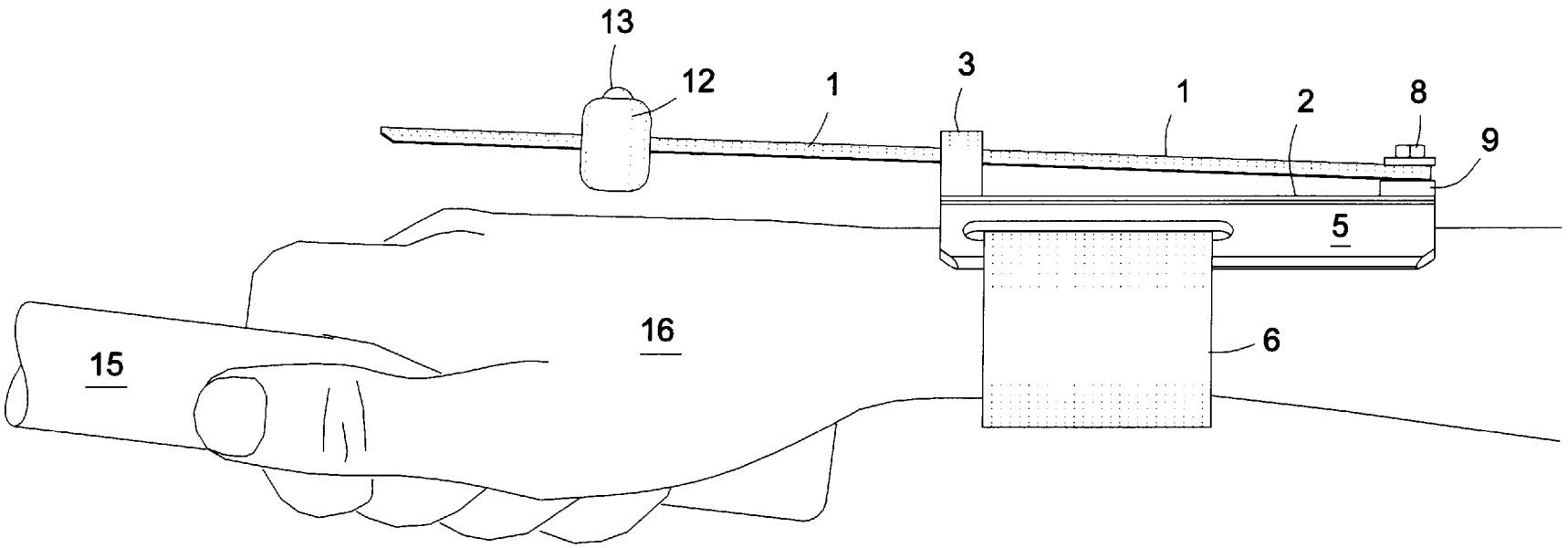

FIG. 7 Side view on invention on straight wrist of a user

REFERENCE NUMERALS 1. clicker blade
2. base
3. blade retaining boss
4. plastic hinge
5. plastic wing
6. wrist strap
7. Velcro type hook and loop fastening material
8. blade attachment bolt or screw
9. blade attachment boss
10. slot in plastic wing for wrist strap
11. soft pad
12. adjustment block
13. clamping screw for adjustment block
14. open-ended slot in adjustment block
15. handle of golf club
16. hand of user
17. wrist of user

DESCRIPTION

The preferred embodiment of the invention is shown in the drawings herein. A spring steel blade (1), such as used on measuring tapes, is strapped to a golfer's wrist as shown in FIG. 6. The blade has a curved cross section as shown in FIGS. 2 and 3. When this blade is bent past a certain angle, it abruptly transitions to a straight cross section at a point on its length, emitting an audible click. The wrist angle at which this click occurs can be adjusted by the position of block (12) on the blade. Block (12) slips onto the blade, and slides to a desired position, where it is fixed by a screw (13). This screw clamps the block onto the blade by pinching the slot (14) through which the blade passes. The block can thus be adjusted for comfort and for timing of the click.

A golfer using this device is aware of his/her changing wrist angle during golf swings. This feedback is useful in training the golfer to start and maintain a wrist angle similar to FIG. 6 on the back swing, continue this angle on the down swing until near ball contact; and return to this angle on the follow-through. Each transition from straight to angled wrist, and each transition from angled to straight wrist, is indicated by a click, so the golfer and instructor can optimize the swing.

A plastic base (2), provides a structure to which the elements are attached. It preferably includes hinged wings (5), to conform to wrists of different sizes with minimal manufacturing cost. The base (2) can be molded as one part including the blade-retaining boss (3), and blade attachment boss (9). A soft pad (11) is attached to the wrist side of the base. Slots (10) in the wings retain a wrist strap (6), which wraps around a user's wrist (17) and attaches with Velcro type hook and loop material (7) as shown, or any other preferred means.

The clicker blade is attached at one end to the base (2), on a boss (9) which provides thread depth for bolts or screws (8). A plastic adjustment block (12) has an open-ended slot (14), part of which conforms to the blade cross section. A screw (13) enters into the adjustment block on a first side of the slot without threads, and continues into a second side of he slot with threads, such that tightening the screw reduces the width of the slot to clamp the adjustment block onto the blade at a desired position.

OPERATION OF PREFERRED EMBODIMENT

A user straps the device onto the wrist which leads the back swing, as shown in FIG. 6. The ends of the strap are fastened together with a comfortably snug fit. The adjustment block (12) is positioned on the blade to achieve the desired sensitivity, and the clamping screw (13) is tightened. The audible feedback is then monitored during practice to optimize and check the golf swing until the desired control of wrist angle is achieved.

Although the present invention has been described herein with respect to preferred embodiments, it will be understood that the foregoing description is intended to be illustrative, not restrictive. Modifications of the present invention will occur to those skilled in the art. All such modifications which fall within the scope of the appended claims are intended to be within the scope and spirit of the present invention.

In the claims, "forward" means the direction on the device when in use that is toward the user's hand. "Front end" means the end of the device when in use that is nearest the users hand. "Back end" means the end of the device when in use that is farthest from the user's hand.

I claim:

1. An audible wrist angle indicator for golfers, comprising:

a base having front and back ends;

a wrist strap on the base for attaching the base to the back of a user's wrist;

an elongated clicker blade having front and back ends;

the clicker blade attached to the base with the front end of the clicker blade extending from the front end of the base;

a block slidably mounted on the front end of the clicker blade for contact with the back of a user's hand at a selectable pressure point;

means for fixing the block to the blade at a selectable position thereon;

whereby a user can attach the base to the back of a user's wrist with the wrist strap, such that the front end of the clicker blade extends over the back of the user's hand, and the adjustment block contacts the back of the user's hand at a selectable position when the wrist is cocked.

2. The audible wrist angle indicator of claim 1, wherein the base comprises a plate of semi-flexible material with an elastically hinged wing extending from each of two sides of the base, and the wrist strap is attached to the base via the wings; whereby when the wrist strap is tensioned on a user's wrist, a comfortable channel is automatically formed around the wrist between the two flexed wings for aligning the base on a wrist of any size.

3. The audible wrist angle indicator of claim 1, wherein the back end of the blade is attached to a blade attachment boss on the back end of the base, and an intermediate portion of the blade is retained against the front end of the base by a retaining boss which encircles the blade.

4. An audible wrist angle indicator for golfers, comprising:

a base having first and second ends, and first and second sides;

a wrist strap on the base for attaching the base to a user's wrist;

an elongated clicker blade having first and second ends, the first end of the blade attached to the base;

a blade retaining boss attached to the base and retaining the blade between the first and second ends of the blade;

an adjustment block slidably mounted on the second end of the blade for contact with the back of a user's hand at a selectable position;

whereby a user can attach the base to the back of the wrist and can cause the clicker to sound by cocking the wrist back such that the hand contacts the adjustment block.

5. The audible wrist angle indicator of claim 4, wherein the base comprises a plate of semi-flexible material, including an elastically hinged wing extending from each of the two sides of the base, and the wrist strap is attached to the base via the wings; whereby when the wrist strap is tensioned on a user's wrist, a comfortable channel is automatically formed around the wrist between the two flexed wings for aligning the base on a wrist of any size.

6. The audible wrist angle indicator of claim 4, wherein the first end of the blade is attached by a bolt to a blade attachment boss on the first end of the base, and the blade retaining boss comprises a loop on the second end of the base which encircles the blade.

* * * * *